United States Patent [19]

Ohta et al.

[11] 4,434,873

[45] Mar. 6, 1984

[54] ELECTRIC ELEVATOR CAR DRIVING DEVICE

[75] Inventors: Kazutoshi Ohta, Nagoya; Eiki Watanabe, Inazawa, both of Japan

[73] Assignee: Mitsubishi Denki Kabushiki Kaisha, Tokyo, Japan

[21] Appl. No.: 353,969

[22] Filed: Mar. 2, 1982

[30] Foreign Application Priority Data

Apr. 9, 1981 [JP] Japan ..... 56-53535

[51] Int. Cl.[3] ..... B66B 1/00

[52] U.S. Cl. ..... 187/28; 340/19 R

[58] Field of Search ..... 187/17, 28, 32, 81, 187/82, 89; 318/445; 340/679, 52 A, 648, 19 R; 474/177, 178, 190, 191

[56] References Cited

U.S. PATENT DOCUMENTS 3,677,370 7/1972 Devine ..... 340/19 R 4,263,578 4/1981 Fukuhara et al. ..... 340/679

FOREIGN PATENT DOCUMENTS 2036919 7/1980 United Kingdom ..... 474/178

*Primary Examiner*—Joseph J. Rolla

*Assistant Examiner*—Kenneth Noland

*Attorney, Agent, or Firm*—Wenderoth, Lind & Ponack

[57] ABSTRACT

An electric elevator car drive has a sheave having grooves lines with non-metallic linings, and a controller which stops the elevator car when the linings are damaged. The grooves of the sheave have a plurality of metallic projections projecting thereinto which are normally covered by the non-metallic layers but which come into secure engagement with the cable when the layers are damaged. A fault detector detects the damage done to the layers, and, when damage to the layers are detected, the controller stops the elevator car at the nearest floor at which it can be stopped safely without damage to the cables suspending the elevator car.

10 Claims, 6 Drawing Figures

ELECTRIC ELEVATOR CAR DRIVING DEVICE

BACKGROUND OF THE INVENTION

1. Field of the Invention

This invention relates to electric elevators, and more particularly to an electric elevator car driving device comprising a combination of a sheave having non-metallic cable race linings and a controller which stops the elevator car when the cable race linings are damaged.

2. Description of the Prior Art

In electric elevator car drives, the sheave transmits power from the electric motor to the cables which carry the elevator car at one end thereof. This, it is important that the sheave have a great traction ability, which is measured in numerical terms by the ratio of the tensile forces on the tight and the slack parts of the cable on opposite sides of the sheave. In conventional electric elevator car drives, however, the sheave, which is made of metal, directly engages with the cables in grooves formed around the circumferential surface of the sheave. Thus, because the coefficient of friction between the metallic sheave and the cables is small, it is difficult to increase the traction effect of the sheave without adverse effects. For example, although an acute V-shaped groove increases the traction between the sheave and the cables, it also makes the life of the cables shorter and generates more noise during operation.

Thus, it has been proposed to fit non-metallic inserts in the sheave grooves in order to increase the coefficient of friction between the sheave grooves and the cables, and to increase the traction between the sheave and the cables. Such a sheave structure is described, for example, in R. S. Philoips, "Electric lifts", sixth edition, Pitman Publishing, in connection with FIGS. 4.8 and 4.9.

Although this measure apparently increases the traction between the sheave and the cables, it may also create a safety problem; namely the traction between the sheave and the cables is suddenly decreased when the non-metallic inserts fitted in the grooves become worn to the extent that they are broken and torn away. This sudden decrease in the traction between the sheave and the cables may cause the cables to slip, with a consequent adverse effect on the car.

SUMMARY OF THE INVENTION

Thus, it is an object of the present invention to provide an electric elevator car driving device comprising a sheave which is provided with non-metallic cable race linings, the traction of which is not decreased even when the cable race linings are damaged and torn away.

Another object of the present invention is to provide such a driving device which will safely stop and land the elevator car as soon as possible when the non-metallic cable race linings are damaged.

The electric elevator car driving device according to the present invention comprises a metallic sheave which has a plurality of metallic projections situated in the groove or grooves formed around the circumferential surface of the sheave. A layer of a material which has a greater coefficient of friction relative to the cable than the metal of the sheave is disposed in the groove and covers the projections situated in the groove. This layer forms the cable race during the normal operation of the elevator car driving device. When the layer is damaged and torn away, the projections come into secure engagement with the cable, and thus the traction between the sheave and the cable is maintained substantially at the same level as before the layer was torn away.

The elevator car driving device according to the present invention further comprises a fault detector which detects the occurrence of damage to the layer in the groove, and a controller which controls the elevator car to bring it to a stop at a floor when occurrence of damage to the layer in the groove is detected. Thus, the damage to the cables due to the projections are minimized. It is preferable that the controller stop the elevator car at the nearest possible floor at which the elevator car can be stopped, but while keeping the deceleration and the jerking of the car at the respective maximal values that can be withstood in the normal operation of the elevator car. The jerking of the car is the temporal rate of change of the acceleration or deceleration of the car, and thus corresponds to the temporal change rate of the force applied from the sheave to the cable.

It is further preferred that the controller of the driving device according to the present invention first determine, upon detection of the occurrence of damage to the layer in the groove, whether or not the elevator car can be stopped at a floor while adhering to a first set of conditions, i.e. the deceleration of the car being kept at a first predetermined value which is less than the normal maximal value of the deceleration, and the jerking of the car being at a second predetermined value which is not more than the normal maximal value of the jerking. Namely, the controller calculates the shortest distance So which will be travelled by the car before it is stopped, when such first conditions for the deceleration and the jerking of the car are adhered to, and determines whether or not this distance So is less than the distance Sm which is the distance from the position of the car at the time of detection of occurrence of damage to the terminal floor situated in the direction of the movement of the elevator car at the time of detection, namely the top or the bottom floor, depending on whether the car is ascending or descending.

The first predetermined value of the deceleration may be half the normal maximal value thereof, while the second predetermined value of the jerking may be equal to the normal maximal value of the jerking.

If the distance So is less than the distance Sm, then the car is controlled so as to stop at the nearest floor at which the car can be stopped under the above-mentioned first conditions of the deceleration and the jerking. If not, the car is controlled to stop at the nearest floor at which the car can be stopped under the second set of conditions which are that the deceleration and the jerking of the car are kept at their respective normal maximal values.

Thus, not only is the distance travelled by the car after occurrence of damage to the layer in the groove minimized, but the force action between the sheave and the cable and the temporal change rate thereof is minimized.

Further, limiting the distance travelled by the car after the detection of damage to the layer in the groove makes it possible to keep the speed of the car as small as possible under the above described conditions of the deceleration and jerking of the car.

Thus, the driving device according to the present invention can reduce the damage done to the cables and safely land the elevator car after the layer in the groove is damaged.

BRIEF DESCRIPTION OF THE DRAWINGS

Further objects and advantages of the invention, and the structure of the electric elevator car driving device according to the invention will become more apparent from the following detailed description of the preferred embodiments taken in conjunction with the accompanying drawings, in which.

In the drawings, like reference numerals and characters represent like or corresponding parts and quantities.

DETAILED DESCRIPTION OF THE PREFERRED EMBODIMENTS

Figure 1:
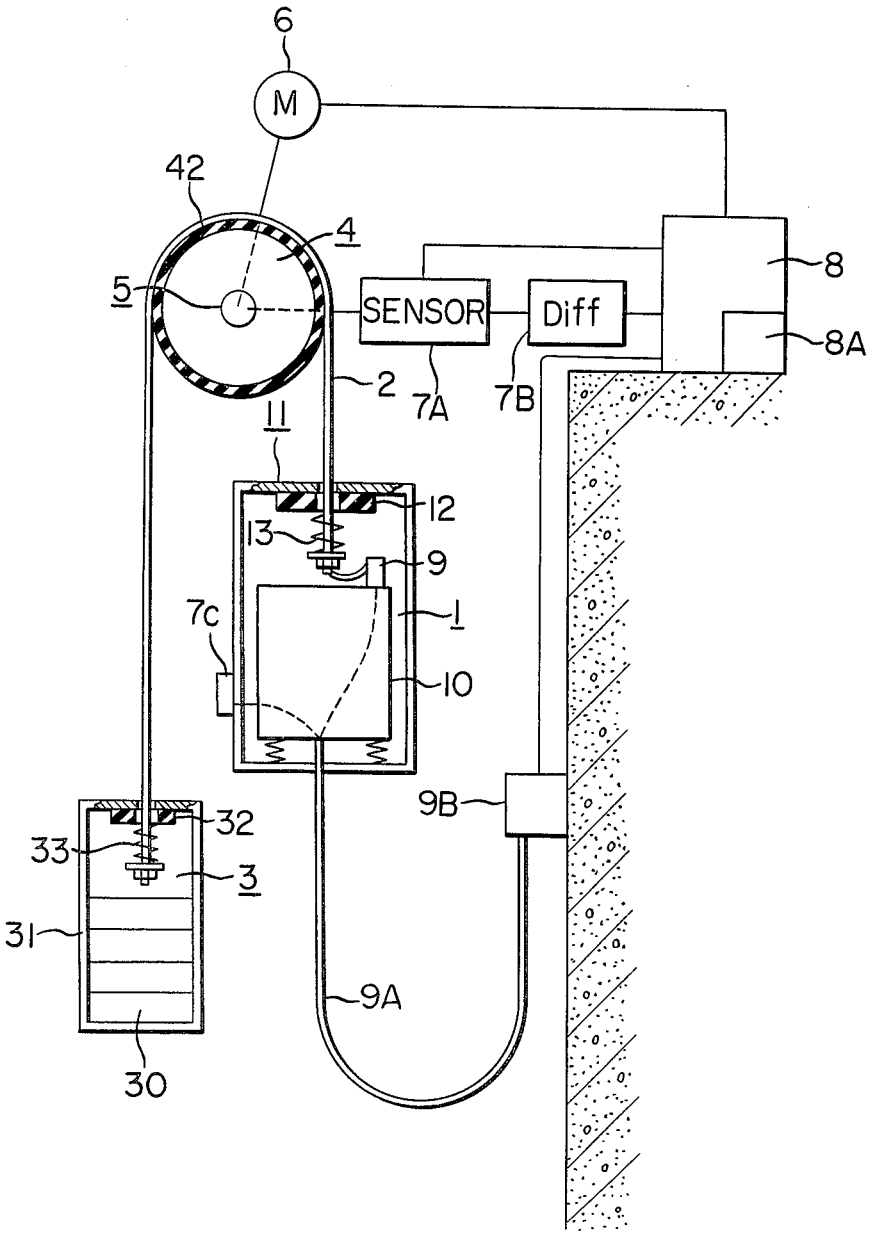
FIG. 1 is a schematic overall view of the electric elevator car driving device according to the present invention.
Figure 2:
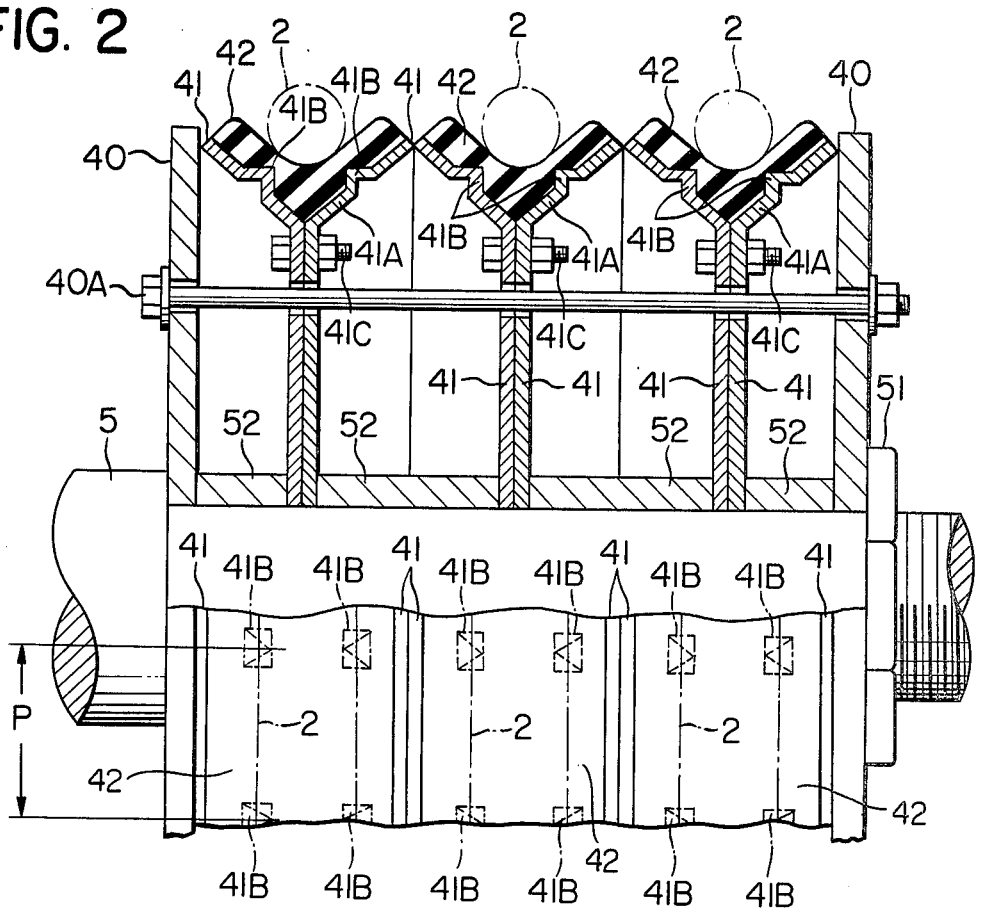
FIG. 2 is a partial cross-sectional view of a sheave forming part of the elevator driving device of FIG. 1.
Figure 3:
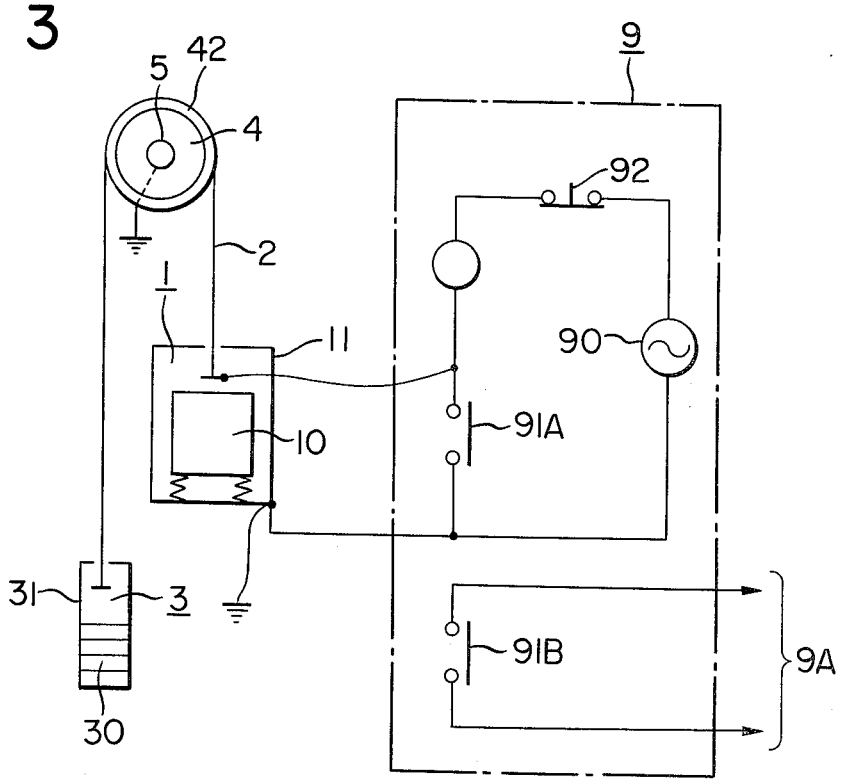
FIG. 3 is a circuit diagram of a fault detector forming part of the elevator driving device of FIG. 1.

Referring now to FIGS. 1 to 3 of the drawings, the construction of an embodiment of the elevator car driving device according to the present invention will be described.

The overall structure of the driving device is shown in FIG. 1. An elevator car structure 1 hanging from one end of the main cables 2 is balanced by a counter weight 3 hanging from the other end of the main cables 2. The cables 2 are reeved over the sheave 4 in the cable races formed by non-metallic linings 42 fixed around the circumferential portion of the sheave 4. The cables 2 are driven by the sheave 4 through the linings 42. The sheave is fixedly mounted on the driving shaft 5, which, in its turn, is driven by the electric motor 6, the rotation of which is controlled by the control means 8.

The elevator car structure 1 comprises an elevator car 10 and an elevator car frame 11 which accommodates the elevator car 10. The car frame 11 is carried by one end of the main cables 2 through an insulator plate 12 and springs 13. The insulator plate 12 positions the steel cables 2 so that the cables 2 are kept out of contact with the metallic frame 11. The counter weight arrangement 3 comprises a counter weight 30 and a counter weight frame 31 accommodating the weight 30. The counter weight frame 31 is carried by the other end of the cables 2 through an insulator plate 32 and springs 33. The insulator plate 32 also keeps the ropes 2 out of contact with the metallic frame 31.

A fault detector 9 attached to the elevator car 10 detects the occurrence of damage to the linings or layers 42 and feeds the fault signal to the controlling means via the movable cable 9A and the junction box 9B. Upon receiving the fault signal, a controller 8A comprising a microcomputer in the controlling means 8 controls the rotational speed of motor 6 and the sheave 4 so that the elevator car is stopped safely and without damage, as will be explained in detail hereinafter.

A speed sensor 7A detects the rotational speed of the driving shaft 5 which corresponds to the velocity of the elevator car, and feeds the speed signal to the controlling means and the differentiator 7B. The differentiator 7B differentiates the speed signal fed from the sensor 7A and thus obtains an acceleration signal corresponding to the acceleration of the elevator car 10. The acceleration signal of the differentiator 7B is also fed into the controlling means 8. The position sensor 7C attached to the elevator car frame 7C senses the position of the elevator car 10 with respect to the floors of the building in which the elevator system is installed. The position signal generated from the position sensor 7C is fed into the controlling means via the movable cable 9A and the junction box 9B. All these signals are utilized by the controller 8A in controlling the rotation of the motor 6 and the sheave 4.

All these sensors and circuits 7A, 7B, and 7C are well known in the art and further explanation of the structures thereof is deemed unnecessary.

The structure of the sheave 4 is shown in detail in FIG. 2.

The sheave 4 comprises a pair of metallic side plates 40 and a plurality of groove forming plates 41. In the embodiment illustrated, the sheave 4 comprises three pairs of groove forming plates 41 constituted by dish-shaped steel plates. The groove forming plates 41 of each pair have the bases against each other with the upwardly turned edges 41A extending away from each other to define a groove therebetween.

The bases are fixed together by bolts 41C. The pairs of groove-forming plates 41 thus form the respective V-shaped grooves therebetween around the circumferential surface of the sheave. The side plates 40 and the groove forming plates 41 are fitted onto the driving shaft 5 with partition cylinders 52 therebetween, and they are fixedly secured to the shaft 5 by the nut 51 which is fastened around one threaded end of the shaft 5. Bolts 40A hold the side plates 40 together. The side plates 40, the groove forming plates 41, and the partition cylinders 52 are fixedly secured to the shaft 5 by respective keys (not shown).

A plurality of projections 41B are formed on the groove forming surfaces of the groove forming plates 41 and are covered by annular non-metallic layers 42 formed of a material which has a greater coefficient of friction with the cables 2 than the metal of which the groove-forming plates 41 are made. The layers 42 are formed, for example, of synthetic resin or rubber. The projections 41B are situated in such a position that the cables 2 will come into engagement therewith when the layers 42 forming the cable races for the cables 2 are eventually damaged and torn away. Each of the groove-forming plates 41 has more than four projections, and the circumferential pitch P of the projections 41B is chosen so as to be less than the strand pitch of the main cables 2, so that the projections 41B will come into more secure engagement with the cables 2. For example, they can be shaped to come into positive mechanical engagement with the cable. Further, for the same purpose of secure engagement, the projections 41B may have pointed tops, as in the illustrated embodiment, or may have the form of a thin plate extending parallel to the strands of the main cables 2. The layers 42 have a thickness sufficient not only completely to cover the projections 41B but also to substantially absorb the local stress resulting from the projections 41B.

The construction of the fault detector 9 is shown in FIG. 3.

The fault detector 9 comprises an electrical voltage source 90 and a fault detector relay coil 91 coupled thereacross through a reset switch 92. One terminal of the voltage source 90 is grounded through the metallic elevator car frame 11. The other terminal of the voltage source 90 is coupled to one end of the steel cables 2 through the reset switch 92 and the fault detector relay coil 91. The fault detector relay further comprises normally open contacts 91A and 91B. Normally open contact 91A is a holding contact which is electrically in parallel with cable 2. The normally open contact 91B is coupled in the movable cable 9A and generates a fault signal when it is closed.

Referring now to FIGS. 1 to 6, and especially to FIGS. 3 to 6, the operation of the elevator car driving device according to the present invention will be described.

In the normal operation of the electric elevator car driving device of FIGS. 1 to 3, the main cables 2 are reeved over the cable races formed by the layers 42 on the sheave 4. Thus the sheave 4 can exert a great traction force due to the large coefficient of friction between the layers 42 and the cables 2. The steel cables 2 are also electrically insulated from the sheave 4 and the car frame 11 by the layers 42, which are of an electrically insulating non-metallic material, and by the insulator plate 12, respectively. The sheave 4 and the car frame 11 are grounded and held at the potential, i.e. zero. Thus, the cables 2 are held at the same potential as the terminal of the voltage source 90 which is connected to the normally closed reset switch 92. As shown by dotted lines in FIG. 5, the car is driven according to the normal speed pattern V2, with the acceleration and deceleration patterns A2 and D2. The normal maximal magnitudes of the acceleration and deceleration are shown by am and bm. The normal magnitude of the jerking corresponds to the inclination of the curves A2 and D2 at the inclined portions thereof.

When, however, the non-metallic layers 42 are damaged and the steel cables 2 come into engagement with the metallic projections 41B, the cables 2 are grounded via the sheave 4 and the driving shaft 5. Thus, the fault detector relay coil 91 is activated by the current from the voltage source 90 through the reset switch 92, the relay coil 91, the cables 2, the sheave 4, the shaft 5, ground, and the elevator car frame 11. Thus, the normally open contact 91A is closed and the relay coil 91 is helt in the energized state. At the same time, the normally open contact 91B is also closed and the fault signal is fed to the controlling means 8 via the movable cable 9A and the junction box 9B.

Upon receiving the fault signal from the fault detector 9, the controller 8A comprising a microcomputer controls the rotation of the electric motor 6 and the sheave 4 to stop the elevator car structure 1 in the manner as explained in detail hereinafter.

Figure 4:
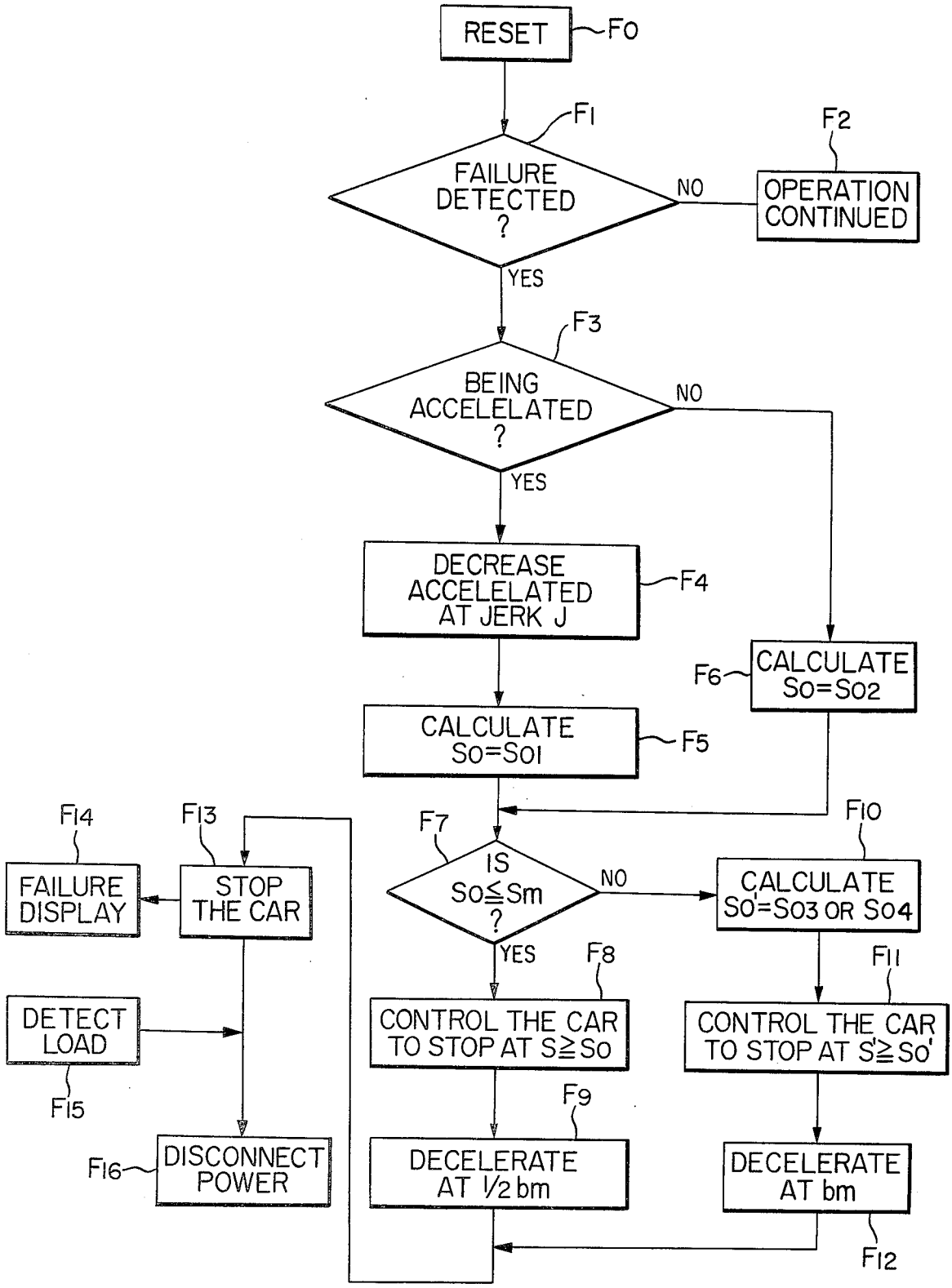
FIG. 4 is a flowchart showing the controlling steps of the controller forming part of the elevator car driving device of FIG. 1.

As shown in FIG. 4 of the drawings, the controller 8A, after having been reset in step Fo, determines in the operation step F1 whether or not a failure signal has been received from the fault detector 9. If no failure signal has been received from the fault detector 9, the controller 8A continues the normal operation of the elevator car as shown in the step F2. On the other hand, if a failure signal is received, the controller 8A then determines whether the acceleration signal from the differentiator 7B is positive or not in the step F3. Namely, the controller 8A determines whether the elevator car arrangement 1 is being accelerated or not, by determining whether the acceleration signal is positive or not. A positive acceleration signal from the differentiator 7B means that the elevator car 10 is being accelerated, while a negative signal means that it is being decelerated. A zero signal from the differentiator 7B means that the car 10 is being driven at a constant velocity or is stopped.

Figure 5:
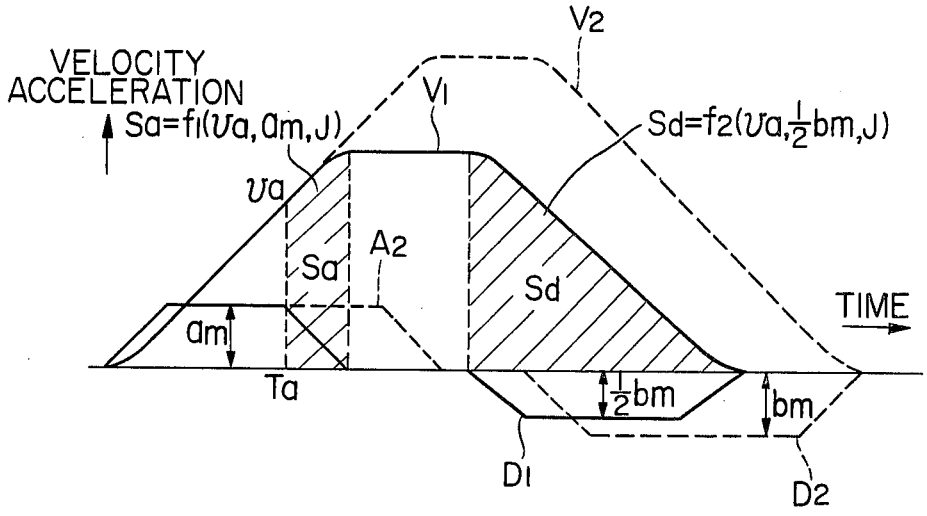
FIG. 5 is a graph showing the change of the velocity and the acceleration of the elevator car driven by the elevator car driving device of FIG. 1 with respect to time, to which the elevator car may be controlled when the damage to the groove layer is detected during acceleration of the elevator car.

If the acceleration signal is positive at the time Ta when the fault detector 9 produces a fault detection signal, the controller then controls, in the step F4, the rotational speed of the electric motor 6 and the sheave 4 in such a way as to decrease the acceleration of the elevator car 10 to zero with a predetermined magnitude of the jerking J of the car 10, as shown by the solid curve A1 in FIG. 5. The predetermined magnitude of the jerking J is chosen to be equal to the above described normal magnitude of the jerking in this embodiment, but may also be chosen to be less than the normal magnitude. Thus, from the time Ta when the layers 42 in the sheave 4 are damaged, the velocity of the elevator car 10 begins to follow the curve V1 instead of the normal curve V2.

At the same time point Ta at which the failure signal from the fault detector 9 is received, the controller 8A calculates the shortest possible distance So within which the elevator car 10 can be stopped if the deceleration of the car 10 is kept at a predetermined value and the jerking of the car 10 is kept at the above mentioned predetermined magnitude J. The predetermined value of the deceleration in this embodiment is chosen to be equal to half the normal maximal value bm of deceleration, namely $\frac{1}{2}$ bm.

In the case where the elevator car 10 is being accelerated at the time point Ta, the shortest distance So is calculated by the controller 8A in step F5 by the following formula:

$$So_1 = Sa + Sd$$

wherein $So_1$ is the shortest possible distance So for this case,

Sa is the distance which the car 10 will travel until the acceleration A1 of the car is reduced to zero, and Sd is the distance which the car 10 will travel after the deceleration begins. These distances correspond to the respective hatched areas Sa and Sd in FIG. 5. Sa is a function f1 of the velocity va at the time point Ta, the normal maximal value am of the acceleration, and the predetermined value J of the jerking, and Sd is a function f2 of the velocity va, the predetermined value of the deceleration $\frac{1}{2}$bm, and the predetermined value J of the jerking. Thus:

$$Sa = f1(va, am, J)$$

$$Sd = f2(va, \tfrac{1}{2}bm, J)$$

The specific forms of these functions f1 and f2 can be readily obtained from a rudimentary knowledge of differential and integral calculus, noting that the acceleration and the deceleration curves A1 and D1 have the form of a trapezoid, as shown in FIG. 5. Thus, as the derivatives of these formulas are well known in the art, the explicit forms of these functions f1 and f2 are omitted.

Figure 6:
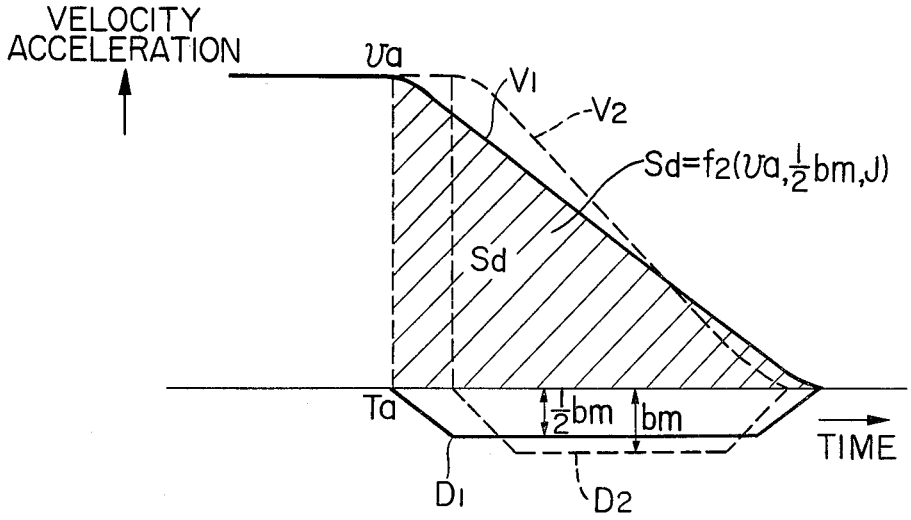
FIG. 6 is a graph similar to FIG. 5, but showing the velocity and acceleration of the elevator car to which the elevator car may be controlled when damage to the groove layer is detected during uniform movement of the elevator car.

In the case where the elevator car 10 is not being accelerated at the time point Ta, on the other hand, the shortest distance So is calculated by the controller 8A in step F6 by the following formula:

$$So_2 = Sd = f2(va, \tfrac{1}{2}bm, J)$$

wherein $So_2$ is the shortest possible distance So for this case, va is the velocity at which the elevator car 10 is running at the time point Ta when the fault detector 9 is activated as shown in FIG. 6. FIG. 6 shows the case where the detector 9 is activated at the time point Ta when the car 10 is running at a constant velocity va. In FIG. 6, the distance Sd corresponds to the area Sd.

In the next operation in step F7, the controller 8A determines whether the distance $So_1$ or $So_2$ calculated as above is less than the distance Sm which is equal to the distance from the elevator car 10 to the top or bottom floor, depending on whether the car 10 is ascending or descending. The distance Sm is obtained from the position signal of the position sensor 7C.

If $So_1$ or $So_2$ is less than Sm, then the controller 8A calculates, in step F8, the nearest floor which is situated at a distance S satisfying the relation $S \geqq So$ and begins to control the rotation speed of the motor 6 and the sheave 4 in a manner so as to stop the car at such nearest floor. In step F9, the controller 8A controls the rotational speed of the motor 6 and the sheave 4 in such a manner as to decelerate the car 10 under a first set of conditions, namely at the above mentioned predetermined value of the deceleration $\frac{1}{2}$bm and the value of jerking J. Thus, the car 10 is decelerated following the speed pattern V1 and the deceleration pattern D1 of FIGS. 5 or 6.

On the other hand; if $So_1$ or $So_2$ is determined to be not less than Sm in step F7, then the controller 8A calculates in step F10 the shortest possible distance So' within which the car 10 can be stopped if the deceleration of the car 10 is at the normal maximal value bm and the jerking of the car 10 is kept at the predetermined magnitude J.

In the case where the elevator car 10 is being accelerated at the time point Ta, the shortest distance So' for this case is calculated in step F10 by the following formula:

$$So_3 = Sa + Sd'$$

wherein $$Sa = f1(va, am, J), \text{ and}$$

$$Sd' = f2(va, bm, J).$$

In the case where the elevator car 10 is not being accelerated at the time point Ta, the shortest distance So' for this case is calculated by the controller 8A in step F10 by the following formula:

$$So_4 = Sd'$$

In the next step F11, the controller 8A determines the nearest floor which is situated at a distance S' satisfying the relation $S' \geqq So'$. Then, in the step F12, the controller 8A controls the rotational speed of the motor 6 and the sheave 4 so as to decelerate the car 10 under a second set of conditions, namely at the normal maximal value of deceleration bm and the value of jerking J.

Following the step 9 or F12, the controller 8A stops the car 10 at the above defined nearest floor which is situated at the distance S or S', opens the doors of the car 10 in the step F13, and activates a failure display within the car 10 or in the operator $\propto$s room in the step 14. A load detector (not shown) detects whether or nor any passengers are still left in the car in the step F15, and when it is detected that no passengers are left in the car, the doors of the car 10 are closed and the elevator system is disconnected from the power source in the step F16 so that the elevator system can not be started inadvertently.

In the above described embodiment, the stopping distance So, which is the shortest distance that the car travels before it can be stopped when the deceleration and the jerking are kept at the predetermined magnitudes $\frac{1}{2}$bm and J, is calculated at the step F5 or F6, and if it is not possible to stop the car 10 with such a small deceleration, then the second stopping distance So', which is the shortest distance the car travels before it can be stopped when the deceleration and the jerking are kept at their normal maximal values bm and J (the predetermined magnitude and the normal maximal value of the jerking are equal in the above described embodiment), is calculated in the stop F10. However, it is also possible to calculate So' (which is $So_3$ or $So_4$ as explained above) instead of So in the step F5 or F6, and then to control the car 10 as indicated in the steps F11, and F12, followed by the steps F13 to F16.

What is claimed is:

1. An electric elevator car driving means for driving an elevator car, which is suspended from a cable, between floors in a building structure, said driving means comprising:

a metal sheave having at least one circular groove in the peripheral surface thereof and having a plurality of metallic projections projecting into said groove;

a layer of material disposed in said groove and covering said projections and forming a cable race;

said cable reeved along said cable race, the material of said layer having a coefficient of friction relative to said cable which is greater than that between said cable and the metal of said sheave, said projections have dimensions for causing them to come into secure engagement with said cable;

drive means connected to said sheave for driving said sheave for driving said cable;

detector means for detecting the occurrence of damage to said layer; and controller means to which said detector means is connected and which is in turn connected to said drive means, said controller means being responsive to said detector means for controlling said drive means for stopping the elevator car before it reaches the floor at the limit of movement of the elevator car in the vertical direction;

wherein said controller means comprises means for calculating a first stopping distance which must be travelled by the elevator car before the elevator car can be stopped under a first set of conditions in which the deceleration and jerking of the elevator car are kept at a first and second predetermined value, respectively, said first predetermined value being less than the normal maximal value of deceleration capable of being withstood by the elevator car and said second predetermined value being not more than the normal maximal value of jerking capable of being withstood by the elevator car, means for comparing said first distance with a second distance which is the distance from the position of the elevator car at the time of occurrence of damage to said layer to the floor at the limit of movement of the elevator car in the direction of movement of the elevator car at the time of occurrence of damage to said layer, and means for, when said first distance is less than said second distance, controlling said drive means for stopping the elevator car at a first nearest floor at which the elevator car can be stopped while operating said drive means under said first set of conditions, and for, when said first distance is not less than said second distance, controlling said drive means for stopping the elevator car at a second nearest floor at which the elevator car can be stopped while operating said drive means under a second set of conditions in which the deceleration of the elevator car is kept at said normal maximal value of deceleration and the jerking of the elevator car is kept at said normal maximal value of jerking.

2. An electric elevator car driving means as claimed in claim 1, wherein said first predetermined value of deceleration is equal to half said normal maximal value of deceleration of the elevator car.

3. An electric elevator car driving means as claimed in claim 2, wherein said material of said layer is a material selected from the group consisting of synthetic resin and rubber.

4. An electric elevator car driving means as claimed in claim 1, wherein said second predetermined value of jerking is equal to said normal maximal value of jerking of the elevator car.

5. An electric elevator car driving means as claimed in claim 4, wherein said material of said layer is a material selected from the group consisting of synthetic resin and rubber.

6. An electric elevator car driving means as claimed in claim 1, wherein said material of said layer is a material selected from the group consisting of synthetic resin and rubber.

7. An electric elevator car driving means for driving an elevator car, which is suspended from a cable, between floors in a building structure, said driving means comprising:

a metal sheave having at least one circular groove in the peripheral surface thereof and having a plurality of metallic projections projecting into said groove;

a layer of material disposed in said groove and covering said projections and forming a cable race;

said cable reeved along said cable race, the material of said layer having a coefficient of friction relative to said cable which is greater than that between said cable and the metal of said sheave, said projections have dimensions for causing them to come into secure engagement with said cable;

driving means connected to said sheave for driving said sheave for driving said cable;

detector means for detecting the occurrence of damage to said layer; and controller means to which said detector means is connected and which is in turn connected to said drive means, said controller means being responsive to said detector means for controlling said drive means for stopping the elevator car before it reaches the floor at the limit of movement of the elevator car in the vertical direction;

wherein said controller means comprises means for controlling the drive means for causing the elevator car to stop at the nearest floor at which the elevator car can be stopped when the deceleration and jerking of the elevator car are kept at the respective normal maximal values of deceleration and jerking capable of being withstood by the elevator car.

8. An electric elevator car driving means as claimed in claim 7, wherein said material of said layer is a material selected from the group consisting of synthetic resin and rubber.

9. An electric elevator car driving means for driving an elevator car, which is suspended from a cable, between floors in a building structure, said driving means comprising:

a metal sheave having at least one circular groove in the peripheral surface thereof and having a plurality of metallic projections projecting into said groove;

a layer of material disposed in said groove and covering said projections and forming a cable race;

a cable reeved along said cable race, the material of said layer having said coefficient of friction relative to said cable which is greater than that between said cable and the metal of said sheave, said projections having dimensions for causing them to come into secure engagement with said cable;

drive means connected to said sheave for driving said sheave for driving said cable;

detector means for detecting the occurrence of damage to said layer; and controller means to which said detector means is connected and which is in turn connected to said drive means, said controller means being responsive to said detector means for controlling said drive means for stopping the elevator car before it reaches the floor at the limit of movement of the elevator car in the vertical direction;

wherein said material of said layer is an electrically insulating material, said cable is made of metal, and said detector means includes insulator means for insulating said cable from ground, voltage means electrically connected to said cable for supplying voltage to said cable, and means for detecting an electric current flowing from said voltage means to said cable.

10. An electric elevator car driving means as claimed in claim 9, wherein said material of said layer is a material selected from the group consisting of synthetic resin and rubber.

* * * * *